US006935495B1

(12) United States Patent
Mc Kenzie

(10) Patent No.: US 6,935,495 B1
(45) Date of Patent: Aug. 30, 2005

(54) CROSSBOW CASE

(76) Inventor: Brian Mc Kenzie, 16111 Mears Dr. SW., Frostburg, MD (US) 21532

( * ) Notice: Subject to any disclaimer, the term of this patent is extended or adjusted under 35 U.S.C. 154(b) by 101 days.

(21) Appl. No.: 10/374,177

(22) Filed: Feb. 25, 2003

(51) Int. Cl.[7] ..... B65D 85/00
(52) U.S. Cl. ..... 206/315.11
(58) Field of Search ..... 206/315.11, 457, 206/470, 477, 478, 486, 488, 490

(56) References Cited

U.S. PATENT DOCUMENTS

| | | | | | |
|---|---|---|---|---|---|
| D182,868 | S | | 5/1958 | Arnold | |
| 2,964,166 | A | * | 12/1960 | Lehner et al. | 206/579 |
| 3,058,505 | A | * | 10/1962 | Emmett | 206/315.11 |
| D246,138 | S | | 10/1977 | Christensen et al. | |
| 4,480,774 | A | * | 11/1984 | Smith et al. | 224/610 |
| 4,773,147 | A | * | 9/1988 | Schurman | 29/415 |
| 5,242,050 | A | * | 9/1993 | Billings | 206/315.11 |
| 5,450,957 | A | * | 9/1995 | Erb | 206/315.11 |
| 5,465,887 | A | * | 11/1995 | Hudson | 224/651 |
| D389,643 | S | * | 1/1998 | Stratton | D3/254 |
| 6,290,114 | B1 | * | 9/2001 | Berberian | 224/642 |
| 6,571,946 | B2 | * | 6/2003 | Fiore, Jr. | 206/315.11 |
| 6,722,496 | B2 | * | 4/2004 | Gantert | 206/315.11 |

* cited by examiner

*Primary Examiner*—Kurt Fernstrom

(57) ABSTRACT

A crossbow case for protecting a crossbow during transportation or storage. The crossbow case includes a housing assembly comprising a base member and a lid member. The base member comprises a perimeter wall defining an interior space of the base member for receiving the crossbow. The lid member is hingably coupled to the base member. The lid member is pivotal between an open position and a closed position. A retention member is positioned in the interior space of the base member. The retention member is designed for being positioned around the crossbow whereby the retention member is positioned between the crossbow and the base member to inhibit contact of the crossbow with the base member and movement of the crossbow in the interior space of the base member.

13 Claims, 3 Drawing Sheets

CROSSBOW CASE

BACKGROUND OF THE INVENTION

1. Field of the Invention

The present invention relates to crossbow carrying cases and more particularly pertains to a new crossbow case for protecting a crossbow during transportation or storage.

2. Description of the Prior Art

The use of crossbow carrying cases is known in the prior art. U.S. Pat. No. 4,480,774 describes a device for supporting a crossbow while the crossbow is being transported by the user. Another type of crossbow carrying case is U.S. Pat. No. Des. 182,868 showing a ski-boot bag. U.S. Pat. No. Des. 246,138 shows a carrying case for an archers bow.

While these devices fulfill their respective, particular objectives and requirements, the need remains for a device that has certain improved features for accommodating a scope mounted to a crossbow.

SUMMARY OF THE INVENTION

The present invention meets the needs presented above by providing a securing member, positioned in the storage space of the lid member, with a depression designed to receive the scope mounted to the crossbow.

Still yet another object of the present invention is to provide a new crossbow case that comprises the base member and the lid member out of rigid material to better withstand impacts and protect the crossbow.

Even still another object of the present invention is to provide a new crossbow case that provides storage for bolts along with the crossbow.

To this end, the present invention generally comprises a housing assembly comprising a base member and a lid member. The base member comprises a perimeter wall. The perimeter wall defines an interior space of the base member. The interior space of the base member is designed for receiving the crossbow. The lid member is hingably coupled to the base member. The lid member is pivotal between an open position and a closed position. The open position is defined by the lid member being pivoted away from the base member permitting access to the interior space of the base member. The closed position is defined by the lid member abutting the base member whereby lid member inhibits access to the interior space of the base member. A retention member is positioned in the interior space of the base member. The retention member is designed for being positioned around the crossbow whereby the retention member is positioned between the crossbow and the base member to inhibit contact of the crossbow with the base member and movement of the crossbow in the interior space of the base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
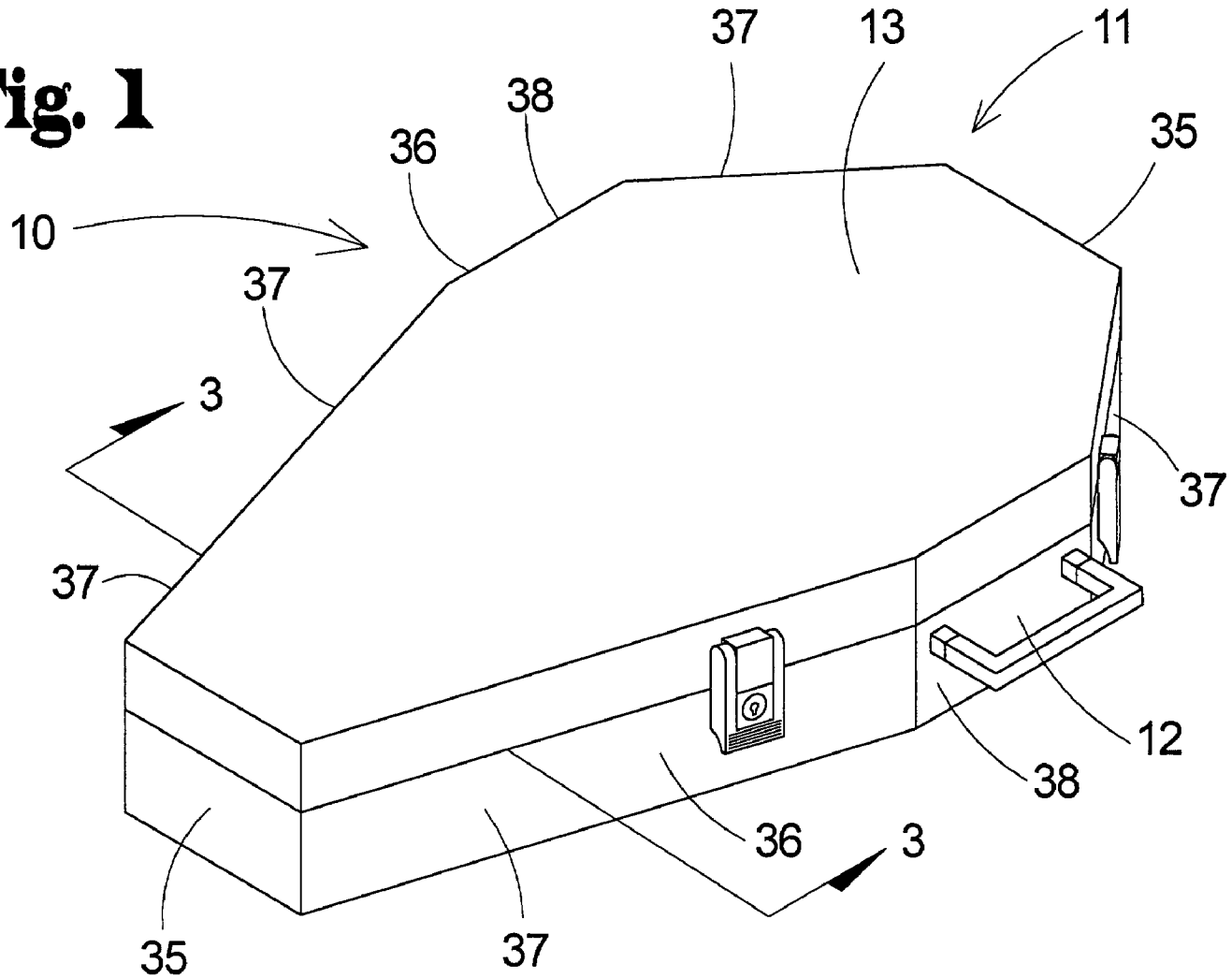
FIG. 1 is a perspective view of a new crossbow case according to the present invention with the lid member in the closed position.
Figure 2:
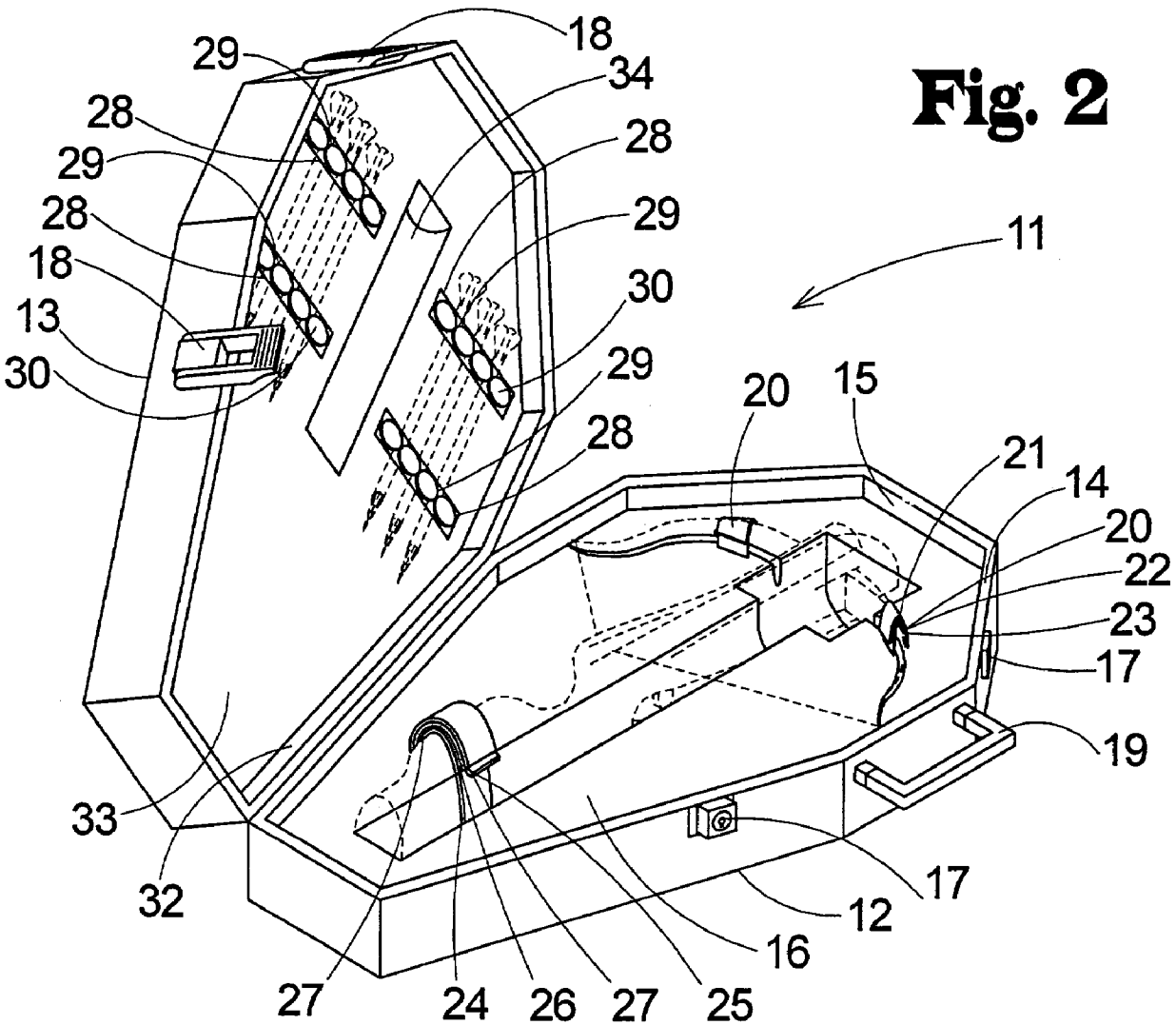
FIG. 2 is a perspective view of the present invention with the lid member in the open position.
Figure 3:
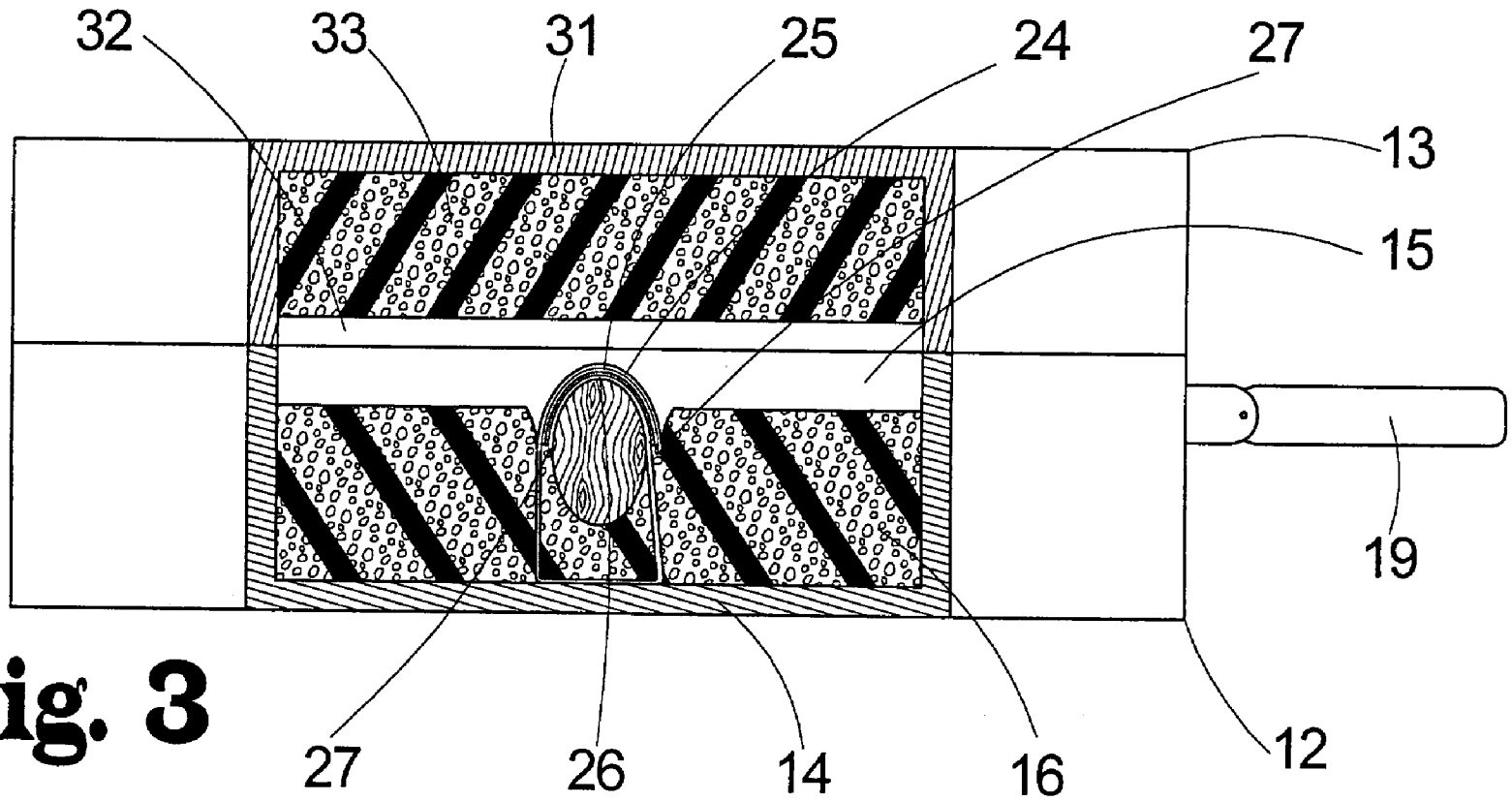
FIG. 3 is a cross-sectional view of the present invention taken along line 3—3 of FIG. 1.

With reference now to the drawings, and in particular to FIGS. 1 through 3 thereof, a new crossbow case embodying the principles and concepts of the present invention and generally designated by the reference numeral 10 will be described.

As best illustrated in FIGS. 1 through 3, the crossbow case 10 generally comprises a housing assembly 11 comprising a base member 12 and a lid member 13. The base member 12 comprises a perimeter wall 14. The perimeter wall 14 defines an interior space 15 of the base member 12. The interior space 15 of the base member 12 is designed for receiving the crossbow.

The lid member 13 is hingably coupled to the base member 12. The lid member 13 is pivotal between an open position and a closed position. The open position is defined by the lid member 13 being pivoted away from the base member 12 permitting access to the interior space 15 of the base member 12. The closed position is defined by the lid member 13 abutting the base member 12 whereby lid member 13 inhibits access to the interior space 15 of the base member 12.

A retention member 16 is positioned in the interior space 15 of the base member 12. The retention member 16 is designed for being positioned around the crossbow whereby the retention member 16 is positioned between the crossbow and the base member 12 to inhibit contact of the crossbow with the base member 12 and movement of the crossbow in the interior space 15 of the base member 12.

A plurality of lock members 17 are coupled to the base member 12. Each of the lock members 17 selectively engages one of plurality of latch members 18 coupled to the lid member 13 to secure the lid member 13 to the base member 12 when the lid member 13 is in the closed position. Each of the lock members 17 selectively disengages the associated one of the latch members 18 to allow the lid member 13 to be pivoted to the open position when the lock members 17 are actuated by the user.

A handle member 19 is coupled to the perimeter wall 14 of the base member 12. The handle member 19 is positioned opposite the interior space 15 of the base member 12. The handle member 19 is designed for being gripped by a user to facilitate carrying the crossbow in the interior space 15 of the base member 12 when the lid member 13 is in the closed position.

A plurality of bow strap members 20 are coupled to the base member 12. Each of the bow strap members 20 is positioned in the interior space 15 of the base member 12 whereby each of the bow strap members 20 extends through the retention member 16. Each of the bow strap members 20 is designed for selectively engaging limbs of a bow of the crossbow to secure the crossbow to the base member 12.

Each of the bow strap members 20 comprises a first fastener member 21 and a second fastener member 22. The first fastener member 21 is positioned on one of a pair of free ends 23 of the associated one of the bow strap members 20 whereby the second fastener member 22 is positioned on the other of the free ends 23 of the associated one of the bow strap members 20. The first fastener member 21 is complimentary to the second fastener member 22 for securing the associated one of the bow strap members 20 around the limbs of the bow of the crossbow to secure the crossbow to the base member 12.

At least one body strap member 24 is coupled to the base member 12. The body strap member 24 is positioned in the interior space 15 of the base member 12 whereby the body strap member 24 extends through the retention member 16. The body strap member 24 is designed for selectively engaging a frame of the crossbow to secure the crossbow to the base member 12.

The body strap member 24 comprises a first fastener portion 25 and a second fastener portion 26. The first fastener portion 25 is positioned on one of a pair of opposing ends 27 of the body strap member 24 whereby the second fastener portion 26 is positioned on the other of the opposing ends 27 the body strap member 24. The first fastener portion 25 is complimentary to the second fastener portion 26 for securing the body strap member 24 around the frame of the crossbow to secure the crossbow to the base member 12.

A plurality of bolt securing member 33*s* 28 are coupled to the lid member 13. Each of the bolt securing member 33*s* 28 comprises a mounting portion 29 and a plurality of clip members 30. Each of the clip members 30 is coupled to the mounting portion 29 of the associated one of the bolt securing member 33*s* 28. Each of the clip members 30 is designed for engaging one of the bolts to secure the associated one of the bolts to the lid member 13 to facilitate storage of the bolts.

The lid member 13 comprises a peripheral wall 31. The peripheral wall 31 of the lid member 13 defines a storage space 32 of the lid member 13. The storage space 32 of the lid member 13 is designed for receiving a scope coupled to the crossbow when the lid member 13 is in the closed position.

A securing member 33 is coupled to the lid member 13 whereby the securing member 33 is positioned in the storage space 32 of the lid member 13. The securing member 33 comprises a depression 34 whereby the depression 34 is designed for receiving the scope of the crossbow to protect the scope when the lid member 13 is in the closed position. The securing member 33 and the retention member 16 both comprise a foamed material such that said foamed material is designed for absorbing force applied to the housing assembly 11 and inhibit the crossbow from being damaged.

The housing assembly 11 comprises a pair of end portions 35 and pair of side portions 36. Each of the side portions 36 extends between the end portions 35 whereby the end portions 35 and the side portions 36 are designed for extending around the crossbow to protect the crossbow from being damaged.

Each of the side portions 36 comprises a pair of extension portions 37 and a medial portion 38. Each of the extension portions 37 extends outwardly from the associated one of the end portions 35. The medial portion 38 is coupled to each of the extension portions 37 opposite the associated one of the end portions 35 whereby the side portions 36 are designed for accommodating the bow of the crossbow when the crossbow is positioned in the interior space 15 of the base member 12.

The base member 12 and the lid member 13 comprises a rigid material. The rigid material is designed for absorbing an impact with a foreign object to protect the crossbow positioned in the interior space 15 of the base member 12.

In use, user places the crossbow into the retention member 16 positioned in the interior space 15 of the base member 12. The user then places the bolts into the bolt securing member 33*s* 28 positioned in the storage space 32 of the lid member 13. The user then pivots the lid member 13 over the base member 12 and secures each of the latch members 18 to the associated one of the lock member to secure the lid member 13 to the base member 12. The user then grips the handle member 19 and lifts the housing member with the crossbow and bolts inside and transports the crossbow and bolts to the desired location.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A crossbow case for protecting a crossbow during storage and transportation, the crossbow case comprising:

a housing assembly comprising a base member and a lid member, said base member comprising a perimeter wall, said perimeter wall defining an interior space of said base member, said interior space of said base member being adapted for receiving the crossbow;

said lid member being hingably coupled to said base member, said lid member being pivotal between an open position and a closed position, said open position being defined by said lid member being pivoted away from said base member permitting access to said interior space of said base member, said closed position being defined by said lid member abutting said base member such that lid member inhibits access to said interior space of said base member; and a retention member being positioned in said interior space of said base member, said retention member being adapted for being positioned around the crossbow such that said retention member is positioned between the crossbow and said base member to inhibit contact of the crossbow with said base member and movement of the crossbow in said interior space of said base member;

said lid member comprising a peripheral wall, said peripheral wall of said lid member defining a storage space of said lid member, said storage space of said lid member being adapted for receiving a scope coupled to the crossbow when said lid member is in said closed position.

2. The crossbow case as set forth in claim 1, further comprising:

a plurality of lock members being coupled to said base member, each of said lock members selectively engaging one of plurality of latch members coupled to said lid member to secure said lid member to said base member when said lid member is in said closed position, each of said lock members selectively disengaging the associated one of said latch members to allow said lid member to be pivoted to said open position when said lock members are actuated by the user.

3. The crossbow case as set forth in claim 1, further comprising:

a handle member being coupled to said perimeter wall of said base member, said handle member being positioned opposite said interior space of said base member, said handle member being adapted for being gripped by a user to facilitate carrying the crossbow in said interior space of said base member when said lid member is in said closed position.

4. The crossbow case as set forth in claim 1, further comprising:

a plurality of bow strap members being coupled to said base member, each of said bow strap members being positioned in said interior space of said base member such that each of said bow strap members extends through said retention member, each of said bow strap members being adapted for selectively engaging limbs of a bow of the crossbow to secure the crossbow to said base member.

5. The crossbow case as set forth in claim 4, further comprising:

each of said bow strap members comprising a first fastener member and a second fastener member, said first fastener member being positioned on one of a pair of free ends of the associated one of said bow strap members such that said second fastener member is positioned on the other of said free ends of the associated one of said bow strap members, said first fastener member being complimentary to said second fastener member for securing the associated one of said bow strap members around the limbs of the bow of the crossbow to secure the crossbow to said base member.

6. The crossbow case as set forth in claim 1, further comprising:

at least one body strap member being coupled to said base member, said body strap member being positioned in said interior space of said base member such that said body strap member extends through said retention member, said body strap member being adapted for selectively engaging a frame of the crossbow to secure the crossbow to said base member.

7. The crossbow case as set forth in claim 6, further comprising:

said body strap member comprising a first fastener portion and a second fastener portion, said first fastener portion being positioned on one of a pair of opposing ends of said body strap member such that said second fastener portion is positioned on the other of said opposing ends said body strap member, said first fastener portion being complimentary to said second fastener portion for securing said body strap member around the frame of the crossbow to secure the crossbow to said base member.

8. The crossbow case as set forth in claim 1, further comprising:

a plurality of bolt securing members being coupled to said lid member, each of said bolt securing members comprising a mounting portion and a plurality of clip members, each of said clip members being coupled to said mounting portion of the associated one of said bolt securing members, each of said clip members being adapted for engaging one of the bolts to secure the associated one of the bolts to said lid member to facilitate storage of the bolts.

9. The crossbow case as set forth in claim 1, further comprising:

a securing member being coupled to said lid member such that said securing member is positioned in said storage space of said lid member, said securing member comprising a depression such that said depression is adapted for receiving the scope of the crossbow to protect the scope when said lid member is in said closed position.

10. The crossbow case as set forth in claim 1, further comprising:

said housing assembly comprising a pair of end portions and pair of side portions, each of said side portions extending between said end portions such that said end portions and said side portions are adapted for extending around the crossbow to protect the crossbow from being damaged.

11. The crossbow case as set forth in claim 10, further comprising:

each of said side portions comprising a pair of extension portions and a medial portion, each of said extension portions extending outwardly from the associated one of said end portions, said medial portion being coupled to each of said extension portions opposite the associated one of said end portions such that said side portions are adapted for accommodating the bow of the crossbow when the crossbow is positioned in said interior space of said base member.

12. The crossbow case as set forth in claim 1, further comprising:

said base member and said lid member comprising a rigid material, said rigid material being adapted for absorbing an impact with a foreign object to protect the crossbow positioned in said interior space of said base member.

13. A crossbow case for protecting a crossbow during storage and transportation, the crossbow case comprising:

a housing assembly comprising a base member and a lid member, said base member comprising a perimeter wall, said perimeter wall defining an interior space of said base member, said interior space of said base member being adapted for receiving the crossbow;

said lid member being hingably coupled to said base member, said lid member being pivotal between an open position and a closed position, said open position being defined by said lid member being pivoted away from said base member permitting access to said interior space of said base member, said closed position being defined by said lid member abutting said base member such that lid member inhibits access to said interior space of said base member;

a retention member being positioned in said interior space of said base member, said retention member being adapted for being positioned around the crossbow such that said retention member is positioned between the crossbow and said base member to inhibit contact of the crossbow with said base member and movement of the crossbow in said interior space of said base member;

a plurality of lock members being coupled to said base member, each of said lock members selectively engaging one of plurality of latch members coupled to said lid member to secure said lid member to said base member when said lid member is in said closed position, each of said lock members selectively disengaging the associated one of said latch members to allow said lid member to be pivoted to said open position when said lock members are actuated by the user;

a handle member being coupled to said perimeter wall of said base member, said handle member being positioned opposite said interior space of said base member, said handle member being adapted for being gripped by a user to facilitate carrying the crossbow in said interior space of said base member when said lid member is in said closed position;

a plurality of bow strap members being coupled to said base member, each of said bow strap members being positioned in said interior space of said base member such that each of said bow strap members extends through said retention member, each of said bow strap members being adapted for selectively engaging limbs of a bow of the crossbow to secure the crossbow to said base member;

each of said bow strap members comprising a first fastener member and a second fastener member, said first fastener member being positioned on one of a pair of free ends of the associated one of said bow strap members such that said second fastener member is positioned on the other of said free ends of the associated one of said bow strap members, said first fastener member being complimentary to said second fastener member for securing the associated one of said bow strap members around the limbs of the bow of the crossbow to secure the crossbow to said base member;

at least one body strap member being coupled to said base member, said body strap member being positioned in said interior space of said base member such that said body strap member extends through said retention member, said body strap member being adapted for selectively engaging a frame of the crossbow to secure the crossbow to said base member;

said body strap member comprising a first fastener portion and a second fastener portion, said first fastener portion being positioned on one of a pair of opposing ends of said body strap member such that said second fastener portion is positioned on the other of said opposing ends said body strap member, said first fastener portion being complimentary to said second fastener portion for securing said body strap member around the frame of the crossbow to secure the crossbow to said base member;

a plurality of bolt securing members being coupled to said lid member, each of said bolt securing members comprising a mounting portion and a plurality of clip members, each of said clip members being coupled to said mounting portion of the associated one of said bolt securing members, each of said clip members being adapted for engaging one of the bolts to secure the associated one of the bolts to said lid member to facilitate storage of the bolts;

said lid member comprising a peripheral wall, said peripheral wall of said lid member defining a storage space of said lid member, said storage space of said lid member being adapted for receiving a scope coupled to the crossbow when said lid member is in said closed position;

a securing member being coupled to said lid member such that said securing member is positioned in said storage space of said lid member, said securing member comprising a depression such that said depression is adapted for receiving the scope of the crossbow to protect the scope when said lid member is in said closed position;

said housing assembly comprising a pair of end portions and pair of side portions, each of said side portions extending between said end portions such that said end portions and said side portions are adapted for extending around the crossbow to protect the crossbow from being damaged;

each of said side portions comprising a pair of extension portions and a medial portion, each of said extension portions extending outwardly from the associated one of said end portions, said medial portion being coupled to each of said extension portions opposite the associated one of said end portions such that said side portions are adapted for accommodating the bow of the crossbow when the crossbow is positioned in said interior space of said base member; and said base member and said lid member comprising a rigid material, said rigid material being adapted for absorbing an impact with a foreign object to protect the crossbow positioned in said interior space of said base member.

* * * * *